US011435047B2

(12) United States Patent
Fischer

(10) Patent No.: US 11,435,047 B2
(45) Date of Patent: Sep. 6, 2022

(54) FRONT LIGHT MODULE

(71) Applicant: Hella GmbH & Co. KGaA, Lippstadt (DE)

(72) Inventor: Bernd Fischer, Altenbeken (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/054,726

(22) PCT Filed: May 21, 2019

(86) PCT No.: PCT/EP2019/063070
§ 371 (c)(1),
(2) Date: Nov. 11, 2020

(87) PCT Pub. No.: WO2019/224185
PCT Pub. Date: Nov. 28, 2019

(65) Prior Publication Data

US 2021/0239290 A1 Aug. 5, 2021

(30) Foreign Application Priority Data

May 24, 2018 (DE) ..... 10 2018 112 453.8

(51) Int. Cl.
*F21S 41/26* (2018.01)
*F21S 41/265* (2018.01)
(Continued)

(52) U.S. Cl.
CPC ..... *F21S 41/26* (2018.01); *F21S 41/143* (2018.01); *F21S 41/151* (2018.01); *F21S 41/265* (2018.01); *F21V 5/046* (2013.01)

(58) Field of Classification Search
CPC ..... F21S 41/143; F21S 41/151; F21S 41/26; F21S 41/265
See application file for complete search history.

(56) References Cited

U.S. PATENT DOCUMENTS 5,158,350 A * 10/1992 Sato ..... F21S 41/28 362/538
6,988,815 B1 * 1/2006 Rizkin ..... F21V 5/04 362/245
(Continued)

FOREIGN PATENT DOCUMENTS

DE 102011085314 B3 4/2013
DE 102013114264 A1 7/2015
(Continued)

OTHER PUBLICATIONS

English Machine Translation of WO 2013120121 provided by ESPACENET (Year: 2013).*

*Primary Examiner* — Zheng Song
(74) *Attorney, Agent, or Firm* — Husch Blackwell LLP

(57) ABSTRACT

A front light module for a headlamp is provided, with a light source unit containing a number of light sources, and with an optical unit featuring a lens for generating a front light distribution ($L_V$). The optical unit features a number of collimator lens elements arranged adjacent to each other. A first collimator lens element features a rotationally symmetrical light emitting surface and a second collimator lens element features a rotationally symmetrical light emitting surface section and a toroidal light emitting surface section.

9 Claims, 3 Drawing Sheets

(51) Int. Cl.

| | |
|---|---|
| ***F21S 41/143*** | (2018.01) |
| ***F21S 41/151*** | (2018.01) |
| *F21V 5/04* | (2006.01) |

(56) References Cited

U.S. PATENT DOCUMENTS

| | | | | |
|---|---|---|---|---|
| 7,077,552 | B2 * | 7/2006 | Ishida | B60Q 1/18 362/545 |
| 2009/0168414 | A1 * | 7/2009 | Bailey | F21V 7/0091 362/231 |
| 2010/0091490 | A1 * | 4/2010 | Reichel | G02B 3/0031 362/235 |
| 2014/0016342 | A1 * | 1/2014 | Rice | F21S 41/27 362/517 |
| 2014/0092619 | A1 * | 4/2014 | Bushre | F21S 41/40 362/520 |
| 2015/0138822 | A1 * | 5/2015 | Tatsukawa | F21S 41/26 362/516 |
| 2016/0010811 | A1 * | 1/2016 | Benitez | F21S 41/153 362/509 |
| 2016/0238208 | A1 | 8/2016 | Wang | |
| 2016/0265733 | A1 * | 9/2016 | Bauer | F21S 41/20 |
| 2018/0187853 | A1 * | 7/2018 | Schiccheri | F21S 41/435 |
| 2019/0143885 | A1 * | 5/2019 | Sugimoto | B60Q 1/143 362/466 |
| 2019/0145600 | A1 * | 5/2019 | Spinger | F21S 41/663 362/277 |
| 2021/0070219 | A1 * | 3/2021 | Roels | F21S 41/255 |

FOREIGN PATENT DOCUMENTS

| | | | |
|---|---|---|---|
| EP | 1818600 | A2 | 8/2007 |
| EP | 2931556 | B1 | 11/2016 |
| WO | 2013120121 | A1 | 8/2013 |

* cited by examiner

FRONT LIGHT MODULE

CROSS REFERENCE

This application claims priority to PCT Application No. PCT/EP2019/063070, filed May 21, 2019, which itself claims priority to German Application No. 10 2018 112453.8, filed May 24, 2018, the entirety of both of which are hereby incorporated by reference.

FIELD OF THE INVENTION

The invention relates to a front light module for a headlamp with a light source unit containing a number of light sources and with an optical unit featuring a lens for generating a front light distribution.

BACKGROUND

A front light module for headlamps is known from EP 2 931 556 B1 that is formed by a light source and a reflector. A disadvantage of the known front light module is that it has a relatively large volume on account of the reflector.

A headlamp for vehicles is known from DE 10 2013 114 264 A1 that has a light source unit and an optical unit for generating a specified light distribution. The optical unit features a lens element. The lens element features several light source groups, such that a low-beam or high-beam function can be generated.

SUMMARY OF THE INVENTION

The task of the present invention is to further develop a front light module for a headlamp in such a way that a relatively wide front light distribution running below a horizontal zero line can be implemented in a manner suitable to save installation space, specifically with an installation height as low as possible.

To solve this task, an optical unit features a number of collimator lens elements arranged adjacent to each other, where a first collimator lens element features a rotationally symmetrical light emitting surface and a second collimator lens element features a light emitting surface section and a toroidal light emitting surface section.

In accordance with the invention, a front light module features several collimator lens elements provided with differing light emitting surfaces. A first collimator lens element features a rotationally symmetrical light emitting surface and a second collimator lens element features both a rotationally symmetrical light emitting surface section and a toroidal light emitting surface section.

The toroidal second light emitting surface section can advantageously effect a vertical deflection downwards of the front light distribution. The toroidal light emitting surface section firstly facilitates a downward shift in the focal lighting point of the front light distribution, such that the statutory values are fulfilled. Secondly, it facilitates a reduction in the dimensions of the front light module with a relatively low installation height.

In accordance with a preferential embodiment of the invention, the toroidal second light emitting surface section is arranged in a lower area of the light emitting surface of the second collimator lens element or in a lower half of the same. The toroidal light emitting surface section is thus located below a horizontal central plane of the collimator lens element, which brings about a deflection downwards.

In accordance with a refinement of the invention, the toroidal light emitting surface section of the second collimator lens element features a circular segment running in a vertical plane and that preferentially runs along an acute angle. The circular segment can feature a radius in the range from 3 mm to 15 mm. This can be advantageously used to deflect downward a part of the right emitted by the light source unit at a relatively large vertical angle, which leads to a front light distribution that is "lower" on a measuring screen.

A relatively low installation height of 15 mm, for instance, is achieved if the collimator lens elements are arranged on a common horizontal plane.

Light source likewise arranged on a horizontal plane are allocated to each of the collimator lens elements. The number of collimator lens elements depends on the installation space within the housing of the headlamp and/or the luminous intensity of the light sources. The higher the luminous intensity of the light sources, the smaller the number of collimator lens elements that can be selected.

In accordance with a refinement of the invention, collimator lens elements of an identical design can be arranged in a common housing. This means that, from a manufacturing perspective, collimator lens elements of an identical design can be grouped together as a single item, for example, which constitutes an advantage.

According to a refinement of the invention, a scatter plate with a plurality of cylindrical surfaces running in a vertical direction is provided for in the main radiation direction of the front light module in front of the collimator lens elements. Advantageously, the scatter plate makes it possible to achieve in a cost effective manner a horizontal scatter of the light beam emitted and thus a sufficiently wide front light distribution.

One sample embodiment of the invention is explained in greater detail as follows based on the drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
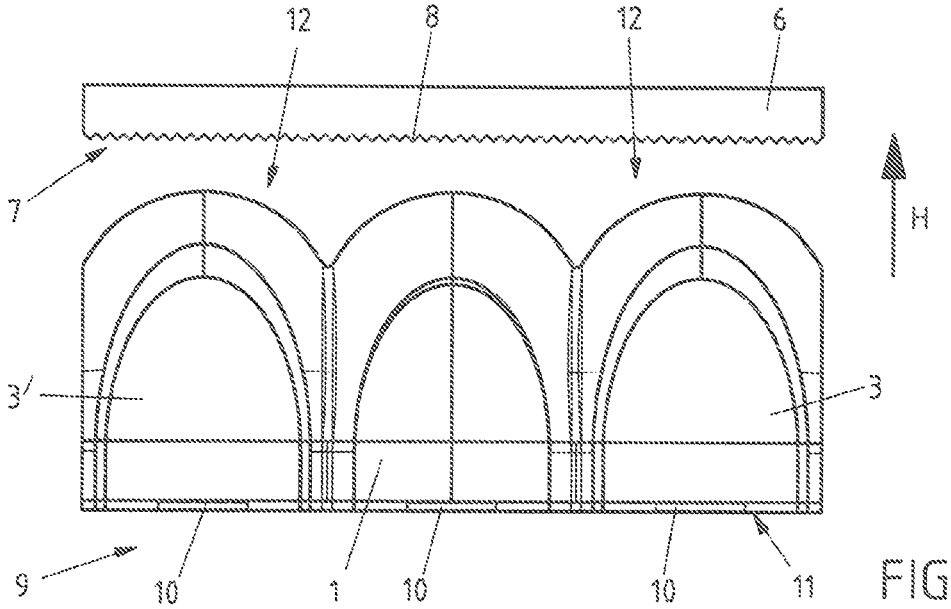
FIG. 1 is a top view of an inventive front light module.
Figure 2:
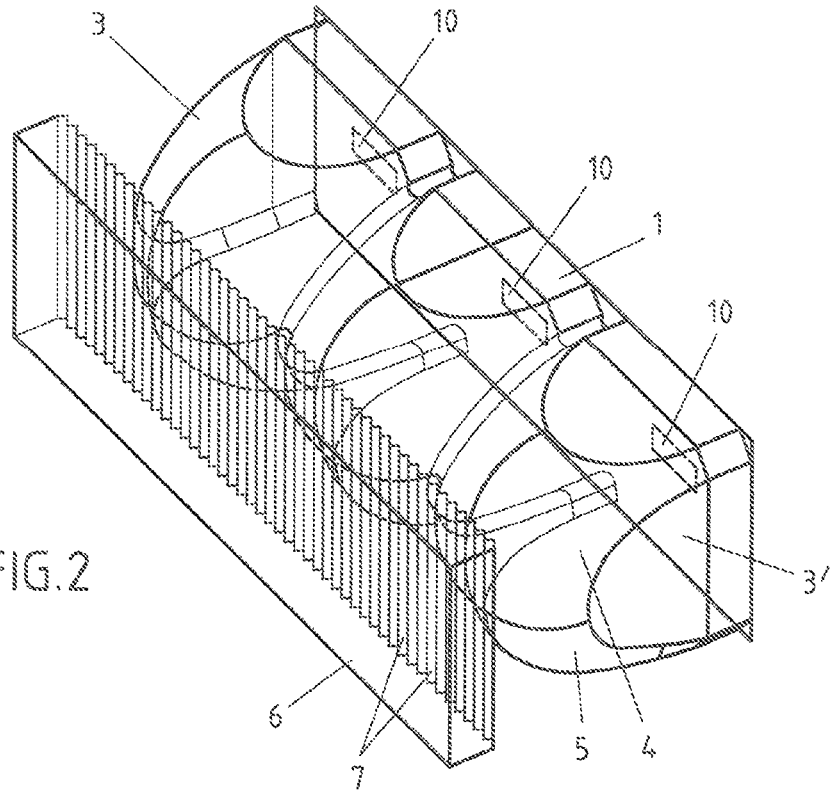
FIG. 2 is a perspective front view of the front light module.
Figure 3:
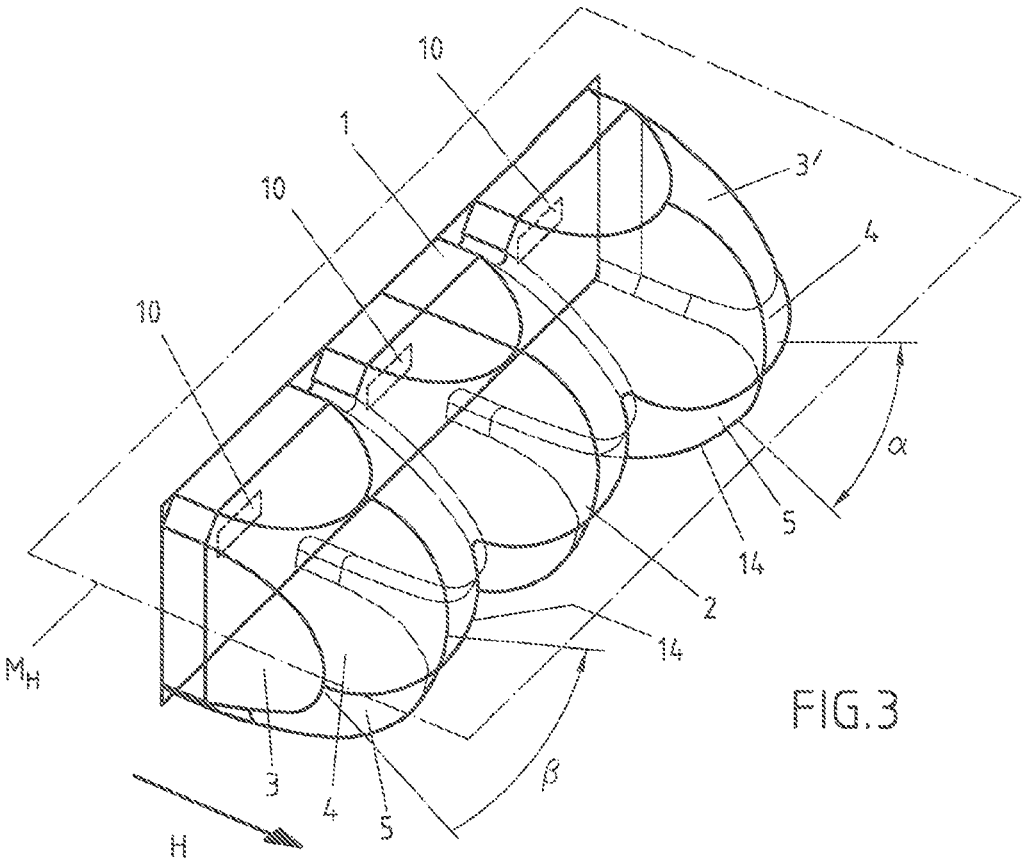
FIG. 3 is a representation of a group of collimator lens elements from the side and front.
Figure 4:
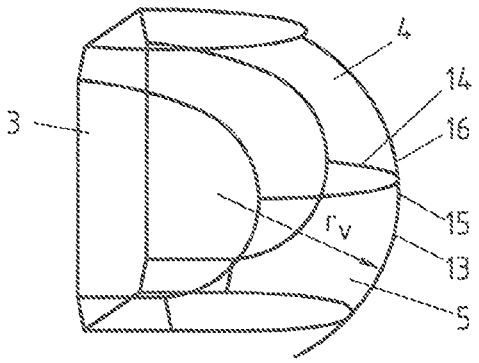
FIG. 4 is a side view of a collimator lens element containing two differently designed light emitting surface sections.

An inventive front light module for the generation of a front light distribution $L_V$ can be combined with a low-beam module (not shown) for generating a low beam distribution or with further modules for generating further light distributions. The front light module is designed in such a way that merely a front light distribution $L_V$ is generated that is arranged below a light-dark cut-off line of the low-beam light distribution on a measuring screen arranged at a distance of 25 m. In particular, the focal lighting point of the front light distribution $L_V$ is arranged in a vertical direction below the partial light distribution of the low-beam light distribution featuring the light-dark cut-off line.

In accordance with one embodiment of the invention, the front light module features a first collimator lens element 1 that features a rotationally symmetrical light emitting surface 2. The rotationally symmetrical light emitting surface 2 can, for example, take the form of an aspherical surface.

Furthermore, the front light module features a second collimator lens element 3, 3' which features a rotationally symmetrical light emitting surface section 4 and a toroidal light emitting surface section 5.

In the present sample embodiment, three collimator lens elements 1, 3, 3' are provided for that are arranged in a common horizontal level. The first collimator lens element 1 is arranged in a center whereas the one second collimator lens element 3 is arranged on a right side (in the main radiation direction H of the front light module) of the first collimator lens element 1 and another second collimator lens element 3' is arranged on a left side of the first collimator lens element 1. The first collimator lens element 1 and the second collimator lens elements 3, 3' can, for example, be connected to each other as one piece. Alternatively, they can also be manufactured as individual parts and installed adjacent to each other in a housing of the headlamp (not shown).

Lens elements 1, 3, 3' can, for example, be manufactured from a plastic material by means of injection molding.

A scatter plate 6 with a plurality of cylindrical surfaces 7 running in a vertical direction is arranged in front of (in the main radiation direction H) the collimator lens elements 1, 3, 3'. The cylindrical surfaces 7 are arranged on a reverse 8 of the scatter plate 6 facing the collimator lens elements 1, 3, 3'. The cylindrical surfaces 7 are arranged adjacent to each other in a horizontal direction and continuously in a vertical direction in each case. They are designed in such a way that the partial light distributions effected by the collimator lens elements 1, 3, 3' are diffused in a horizontal direction.

The collimator lens elements 1, 3, 3' and the scatter plate 6 form an optical unit of the front light module.

A light source unit 9 that features a plurality of light sources 10 is arranged behind the collimator lens elements 1 (in the main radiation direction H). The light sources 10 take the form of LED light sources that are arranged in a central area of the respective collimator lens elements 1, 3, 3'. The light sources 10 allocated to the respective collimator lens elements 1, 3, 3' are arranged in a horizontal central plane MH of the collimator lens elements 1, 3, 3'. Areas of a light receiving side 11 of the collimator lens elements 1, 3, 3' adjacent to the light sources 10 may be vapor coated with opaque material such that this area acts as a cover.

In the present sample embodiment, the second collimator lens elements 3, 3' are identical in design. The rotationally symmetrical light emitting surface section 4 is located in an upper half of a light emitting surface 12 of the second collimator lens elements 3, 3'. The rotationally symmetrical light emitting surface section 2 is thus essentially above the horizontal central plane $M_H$ of the second collimator lens elements 3, 3'. The rotationally symmetrical light emitting surface section 2 is preferentially designed as an aspherical surface.

The toroidal second light emitting surface section 5 forms a lower half of the light emitting surface 12 of the second collimator lens elements 3, 3'. This means it runs essentially beneath the horizontal central plane $M_H$ of the second collimator lens elements 3, 3'.

The toroidal light emitting surface section 5 features a circular segment 13 running in a vertical plane that runs preferentially along a vertical angle $\alpha$ and with a radius $r_V$ in the range from 3 mm to 15 mm. The toroidal light emitting surface section 5 thus runs in a bulbous shape in a vertical level or in a convex shape in the main radiation direction H. The vertical aperture angle $\alpha$ of the vertical circular segment 13 preferentially takes the form of an acute angle.

A horizontal circular segment 14 running in a horizontal direction features a smaller radius than the vertical circular segment 13. The horizontal circular segment 14 features an aperture angle $\beta$ that preferentially takes the form of an acute angle. Alternatively, the horizontal aperture angle $\beta$ can take the form of an obtuse angle or right angle. One upper margin 15 of the toroidal light emitting surface section 5 merges in a differentially constant manner into a lower margin 16 of the rotationally symmetrical light emitting surface section 4. This means that a differentially constant transition is formed between the rotationally symmetrical light emitting surface section 4 and the toroidal light emitting surface section 5.

Figure 5A:
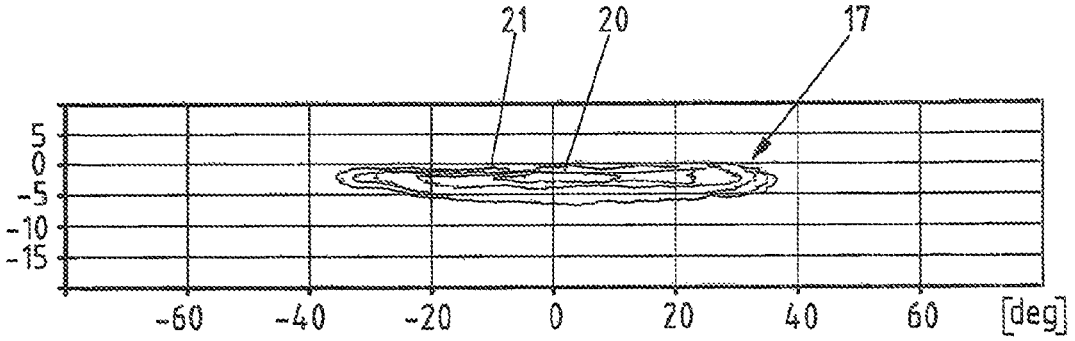
FIG. 5*a* is a first partial light distribution of a front light distribution that is effected by means of a first collimator lens element with a rotationally symmetrical light emitting surface, containing a focal lighting point close to below the horizontal zero line.

In interaction with the scatter plate 6, the first collimator lens element 1 generates a first partial light distribution 17 of the front light distribution $L_V$ as shown in FIG. 5*a*. The first partial light distribution 17 features a maximum luminous density 20 in the vicinity of a light/dark cut-off line 21 of the front light distribution $L_V$.

Figure 5B:
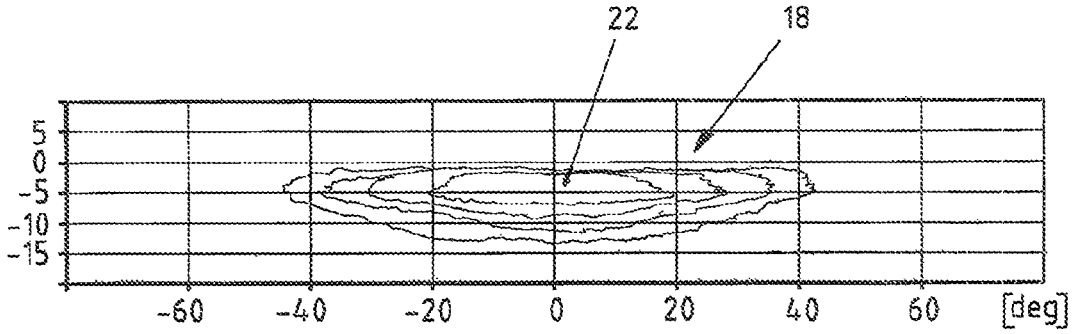
FIG. 5*b* is a second partial light distribution of the front light distribution that is formed by a second collimator lens element with a rotationally symmetrical light emitting surface section and a toroidal light emitting surface section arranged to the right of the first collimator lens element, where the second partial light distribution features a focal lighting point that is arranged below the focal lighting point of the first partial light distribution.
Figure 5C:
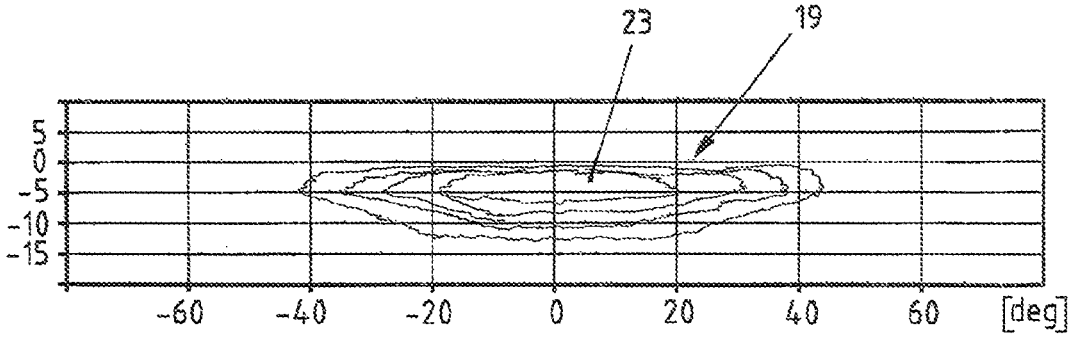
FIG. 5*c* is a third partial light distribution of the front light distribution that is formed by a second collimator lens element with a rotationally symmetrical light emitting surface section and a toroidal light emitting surface section arranged to the left of the first collimator lens element, and where the third partial light distribution features a focal lighting point that is arranged below the focal lighting point of the first partial light distribution.
Figure 5D:
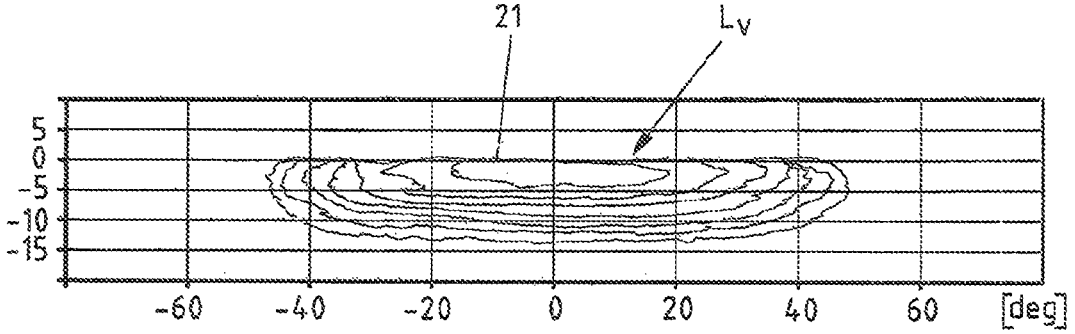
FIG. 5*d* showsthe front light distribution as overlapping of the partial light distribution formed according to FIGS. 5*a*, 5*b* and 5*c*.

The right second collimator lens element 3 generates in interaction with the scatter plate 6 a second partial light distribution 18 according to FIG. 5*b* and the left second collimator lens element 3' generates in interaction with the scatter plate 6 a third partial light distribution 19 according to FIG. 5*c*. The second partial light distribution 18 and the third partial light distribution 19 differ from the first partial light distribution 17 in that a maximum luminous density 22 of the second partial light distribution 18 and a maximum luminous density 23 of the third partial light distribution 19 is arranged below the maximum luminous density 20 of the first partial light distribution 17. Likewise, the second partial light distribution 18 and the third partial light distribution 19 starts at the light/dark cut-off line 21 and runs into a deeper area, i.e. at a relatively large negative vertical angle of less than −10° in comparison to the approximately −5° of the first partial light distribution 17. This vertical deflection downwards is effected by the toroidal second light emitting surface section 5. The overlapping of the first partial light distribution 17 of the second partial light distribution 18 and the third partial light distribution 19 forms the resulting front light distribution $L_V$ according to FIG. 5*d*. The front light distribution $L_V$ thus extends in an angle range of −0.5° to −15° in a vertical direction. In an horizontal direction, the front light distribution $L_V$ extends in a range of +/−50°.

To generate the low-beam distribution, a range module is preferentially allocated to the front light module, the light distribution of which amounts to +/−20° in a horizontal direction. In a vertical direction, it features, where necessary, an asymmetrical light/dark cut-off line. The range module can, for example, be formed by a projection module or by an optical unit allocated to one or several light sources containing a primary optic and containing a secondary optic with a micromirror array or a liquid crystal array.

In accordance with an alternative embodiment (not shown) of the invention, it is firstly possible to install several first collimator lens elements 1 and secondly to install several second collimator lens elements 3, 3' in light modules or housings. These housings may, for example, be arranged horizontally and/or vertically to each other.

LIST OF REFERENCE NUMBERS

1 1. Collimator lens element
2 Rotationally symmetrical light emitting surface
3,3' 2. Collimator lens elements
4 1. Light emitting surface section
5 2. Light emitting surface section
6 Scatter plate
7 Cylindrical surface
8 Reverse
9 Light source unit
10 Light source
11 Light receiving side
12 Light emitting surface
13 Vertical circular segment
14 Horizontal circular segment
15 Upper margin
16 Lower margin
17 1. Partial light distribution
18 2. Partial light distribution
19 3. Partial light distribution
20 Maximum luminous density
21 Light/dark cut-off line
22 Maximum luminous density
23 Maximum luminous density
H Main radiation direction
$L_V$ Front light distribution
$M_H$ Horizontal central plane
$r_V$ Radius
α Angle
β Aperture angle

The invention claimed is:

1. A front light module for a headlamp, the front light module comprising:

a light source unit including a first light source and a second light source;

an optical unit including a lens for generating a front light distribution, the optical unit including a plurality of collimator lens elements arranged adjacent to each other;

the plurality of collimator lens elements including:

a first collimator lens element including a first light emitting surface; and a second collimator lens element adjacent to the first collimator lens element, the second collimator lens element including a second light emitting surface that is different from the first light emitting surface; and wherein the first collimator lens element and the second collimator lens element are structurally separate from one another such that light from the first light source is provided to the first collimator lens element, and light from the second light source is separately provided to the second collimator lens element, and wherein the first light emitting surface includes a rotationally symmetrical light emitting surface, and the second light emitting surface includes both a rotationally symmetrical light emitting surface section and a toroidal light emitting surface section.

2. The front light module in accordance with claim 1 wherein the toroidal light emitting surface section of the second collimator lens element features a vertical circular segment running in a vertical plane and that runs along an acute angle (α).

3. The front light module in accordance with claim 2, wherein the vertical circular segment of the toroidal light emitting surface section features a radius (rV) in the range from 3 mm to 15 mm.

4. The front light module in accordance with claim 1, wherein a scatter plate with a plurality of cylindrical surfaces running in a vertical direction is provided for in the main radiation direction (H) in front of the plurality of collimator lens elements.

5. The front light module in accordance with claim 4, wherein the cylindrical surfaces of the scatter plate are arranged on a reverse of the scatter plate facing the plurality of collimator lens elements.

6. The front light module in accordance with claim 1, wherein the rotationally symmetrical light emitting surface section of the second collimator lens element forms one upper half of a light emitting surface of the second collimator lens element and the toroidal light emitting surface section forms one lower half of the light emitting surface of the second collimator lens element.

7. The front light module in accordance with claim 1, wherein the toroidal light emitting surface section features a horizontal circular segment that runs along an acute angle (β) or along an obtuse or right angle.

8. The front light module in accordance with claim 1, wherein the light source unit features a plurality of light sources to each of which a collimator lens element is allocated.

9. The front light module in accordance with claim 1, wherein the collimator lens elements are arranged adjacent to each other on a first common horizontal plane, and the light sources are arranged adjacent to each other on a second common horizontal plane that is aligned with the first common horizontal plane.

* * * * *